US008671622B2

(12) United States Patent
Thomas

(10) Patent No.: US 8,671,622 B2
(45) Date of Patent: Mar. 18, 2014

(54) DEVICE FOR THE AT LEAST PARTIAL CLOSING OF AN OPENING OF A ROOM

(76) Inventor: Werner Thomas, Asbach (DE)

( * ) Notice: Subject to any disclaimer, the term of this patent is extended or adjusted under 35 U.S.C. 154(b) by 0 days.

(21) Appl. No.: 13/312,070

(22) Filed: Dec. 6, 2011

(65) Prior Publication Data

US 2012/0137584 A1 Jun. 7, 2012

(30) Foreign Application Priority Data

Dec. 6, 2010 (DE) ..... 10 2010 062 449

(51) Int. Cl.
*E05F 15/20* (2006.01)

(52) U.S. Cl.
USPC ..... 49/360; 49/21; 49/31; 49/141

(58) Field of Classification Search
USPC ..... 49/10, 13, 21, 23, 31, 141, 199, 324, 49/360, 449; 160/188, 189, 190, 193, 1, 7, 160/9; 292/DIG. 36
See application file for complete search history.

(56) References Cited

U.S. PATENT DOCUMENTS

| | | | | | |
|---|---|---|---|---|---|
| 1,465,695 | A | * | 8/1923 | Stewart | 49/200 |
| 1,544,751 | A | * | 7/1925 | Haynes et al. | 49/104 |
| 1,551,248 | A | * | 8/1925 | Gilmore | 49/118 |
| 2,512,804 | A | * | 6/1950 | McDonald | 70/151 R |
| 3,394,497 | A | * | 7/1968 | Case | 49/140 |
| 3,722,140 | A | * | 3/1973 | Newton | 49/30 |
| 3,844,063 | A | * | 10/1974 | Jackson | 49/115 |
| 5,371,970 | A | * | 12/1994 | Ganikon | 49/280 |
| 5,642,767 | A | * | 7/1997 | Nair | 160/8 |
| 5,806,245 | A | * | 9/1998 | Satrom | 49/360 |
| 5,860,371 | A | * | 1/1999 | Shelley | 109/11 |
| 5,992,101 | A | * | 11/1999 | Potter | 52/79.7 |
| 6,019,156 | A | * | 2/2000 | Wagner et al. | 160/310 |
| 6,145,568 | A | * | 11/2000 | Lundstrom | 160/84.02 |
| 6,684,931 | B2 | * | 2/2004 | Reimer et al. | 160/190 |
| 7,007,917 | B2 | * | 3/2006 | Choi et al. | 251/65 |
| 7,240,524 | B1 | * | 7/2007 | White et al. | 70/257 |
| 7,677,961 | B2 | * | 3/2010 | DeCastro et al. | 454/56 |
| 2007/0113991 | A1 | * | 5/2007 | Mangelsen et al. | 160/340 |

FOREIGN PATENT DOCUMENTS

| | | | |
|---|---|---|---|
| DE | 76 05 029 | U | 7/1976 |
| DE | 40 24 467 | A1 | 2/1992 |
| DE | 295 08 533 | U1 | 10/1995 |
| DE | 101 42 083 | A | 8/2002 |
| EP | 0 949 398 | A2 | 10/1999 |

* cited by examiner

*Primary Examiner* — Katherine Mitchell
*Assistant Examiner* — Abe Massad
(74) *Attorney, Agent, or Firm* — Muncy, Geissler, Olds & Lowe, P.C.

(57) ABSTRACT

The invention relates to a device (1) for the at least partial closing of an opening (2) of a room comprising a closing element (3) which is placeable sealingly on an opening bottom (1) and is guided vertically movable in guides (4), which are arranged vertically on both sides of the opening (2), between an open position in a upper area of the opening (2) and a closed position on the opening bottom (2) and which is connected to at least one counterweight (5), by means of which the closing element (3) is held motionless in its particular position without an additional force acting on the closing element (3).

According to the invention, the closing element (3) is coupled to at least one pneumatic, hydraulic, and/or motor drive unit (8) for moving the closing element (3).

24 Claims, 2 Drawing Sheets

DEVICE FOR THE AT LEAST PARTIAL CLOSING OF AN OPENING OF A ROOM

This nonprovisional application claims priority under 35 U.S.C. §119(a) to German Patent Application No. DE 10 2010 062 449.7, which was filed in Germany on Dec. 6, 2010, and which is herein incorporated by reference.

FIELD OF THE INVENTION

The invention relates to a device for the at least partial closing of an opening of a room.

BACKGROUND OF THE INVENTION

A retention barrier for fluid-tight closing of door and building openings is known from the state of the art, as described in German Utility Model No. DE 295 08 533 U1. The retention barrier has a barrier body, placeable sealingly on the bottom area of the opening and a receiving body cooperating with the side end sections thereof and arranged at the edges of the opening. The barrier body is made hollow and in the case of an accident can be filled with a liquid. Furthermore, the barrier body is guided movably in the perpendicular direction in rails arranged vertically on both of its sides between a raised position in the upper area of the opening and a locking position in the bottom area and is connected to at least one counterweight keeping it balanced in the empty state.

German Utility Model No. DE 76 05 029 U describes a safety bulkhead. The safety bulkhead for doors or the like for protection against flooding comprises lower and horizontal vertical guides with a U-shaped profile and two side vertical guides with a U-shaped profile for a buckling-resistant hollow bulkhead, deflection pulleys arranged at the upper end of the vertical guide for connecting means acting at one end at the hollow bulkhead and bearing counterweights at the other end, and sealing elements sealing the side and horizontal bulkhead edges in the U-guides.

A device for closing a room is known from DE 40 24 467 A1. The device has a bulkhead which is guided in guides and is transverse to an opening and in the state of closing is sealed fluid-tight against the boundaries of the opening by at least one seal and in normal operation, leaving the opening free, is arranged above said opening. This bulkhead is moved vertically in the guides of a drive. In the upper area or above the opening, a changeover device is provided, which redirects the bulkhead to its arrangement for normal operation from the vertical position to an inclined position.

A vertically sliding window with an outer frame and at least one window sash associated with the outer frame is described in DE 101 42 083 A1. The window sash encloses at least one window pane and is guided in a vertically displaceable manner along the outer frame in lateral guides in the assembled state. At least one drive unit is provided on the outer frame. Said drive unit is coupled to the window sash in such a way that the window sash can be guided in a vertically displaceable manner by means of the drive unit.

EP 0 949 398 B1 discloses a lift gate for closing a door opening of a low-temperature storage room. Guide rails for the door leaf provided with lateral track rollers are provided on the sides of the door opening. Above the guide rails a drivable shaft with winding drums for the pulling means is provided for raising and lowering the door leaf. The door leaf is formed by a thermally insulating panel which is made as a single piece or of panel sections. Heatable sealing beads are arranged on the wall to the side and above the door opening. The door leaf is provided at its bottom edge with a heatable sealing bead, which is formed at the same time as a contact strip. The vertical guide rails of the door leaf in their bottom end sections are provided with directing means, which move the door leaf at the end of its descent against the sealing bead arranged to the side and above the door opening.

SUMMARY OF THE INVENTION

The object of the invention is to provide an improved device for the at least partial closing of an opening of a room.

The object is attained according to the invention by a device for the at least partial closing of an opening of a room with the features of claim 1.

Advantageous embodiments of the invention are the subject of dependent claims.

A device for the at least partially closing of an opening of a room comprises a closing element which is placeable sealingly on an opening bottom and is guided by vertically movable in guides, which are arranged vertically on both sides of the opening, between an open position in a upper area of the opening and a closed position on the opening bottom and which is connected to at least one counterweight, by means of which the closing element is held motionless in its particular position without an additional force acting on the closing element.

According to the invention, the closing element is coupled to at least one pneumatic, hydraulic, and/or motor, for example, electric motor drive unit for moving the closing element, whereby the drive unit is coupled to at least one driving power storage unit.

A device of this kind is used, for example, for sealing the room against water entering the room from outside, for example, in a flood event, or against an escape of liquids from the room into the environment, for example, in an accident in which escape of environmentally harmful substances and/or fire-fighting water from the room is to be prevented. For this reason, the device is installed, for example, at openings of rooms which are used as storage rooms for environmentally harmful substances or as a production facility where substances of this kind are stored, processed, and/or produced.

The closing element, also called, for example, a safety, retention, or accident barrier or bulkhead, is set on the opening bottom sealingly against liquids in the closed position. Further, at least in said closed position, seals are also arranged between the side guides and the closing element.

The side guides are attached to the side of the opening, for example, to an outside wall, for example, on the inside or outside of the outside wall, whereby seals are also arranged at least up to the height of a top side of the closing element in the closed position between the guides and the outside wall. As a result, in the closed position of the closing element the opening of the room is closed fluid-tight up to the height of the top side of the closing element. In this way, a liquid to be retained can reach a damming height which corresponds to the height of the closing element, without entering the room or escaping from the room.

Alternatively, the closing element in this way can also close an opening of a barrier and thereby a room behind the barrier. Barriers of this type are erected, for example, within a room as room dividers and extend, for example, from a room wall to an opposite room wall. The barrier divides the room into two spaces, which can be closed and sealed from each other by the barrier and the closing element. In this case, the side guides for the closing element are arranged to the side of the opening in the barrier and attached to the barrier. A barrier of this kind naturally can also be arranged outside a roof-covered space, for example, in a free area surrounded by side walls, whereby the barrier lies sealingly against the side walls. Two spaces sealable and separated from one another by the barrier and closing element are created in this way in the free area.

The closing element is designed, for example, as a hollow chamber profile made of metal, for example, of aluminum. The hollow chamber profile in this case can comprise a plurality of individual hollow chamber profiles, which are stacked on one another and connected to one another and have the same or a different height and, for example, are welded together. Because a pressure exerted by a dammed up liquid on the closing element in the lower area of the closing element is higher than in the upper area, preferably a height of the individual connected hollow chamber profiles declines in the direction of the upper area; i.e., the lowest hollow chamber profile is made the highest, so that the high pressure acting there is counteracted by a hollow chamber profile, formed as a single piece, and a first weld seam to another hollow chamber profile, arranged thereon, which could be a potential weak point of the closing element, is arranged as high as possible, so that an already lower pressure acts on it. The height of the other hollow chamber profiles will then become increasingly smaller in the direction of the upper area of the closing element.

Because the closing element is in equilibrium with the counterweight and therefore can be held by it in its particular position, only the action of a very small additional force on the closing element is necessary to move the closing element, i.e., to move it from the open position, for example, to the closed position in a hazardous situation and likewise to move the closing element from the closed position to the open position. For this reason, even a relatively low-power drive unit is sufficient to move the closing element and it can be made very small and light and is very cost-effective.

An automatic movement of the closing element to the closed position in a detected hazardous situation is also made possible, for example, by the at least one drive unit, so that manual actuation of the closing element by a person present directly at the closing element is not necessary. In this way, the closing element can be closed immediately right after the detection of the hazardous situation, so that there is no time loss due to an access route to be taken by a person to the closing element. Furthermore, in this way there are also no additional personnel costs and additional costs for a person to operate the closing element, who would need to remain constantly in the immediate vicinity of the closing element for possible hazardous situations.

The at least one driving power storage unit, to which the drive unit is coupled, is, for example, an electric accumulator in the case of an electric motor drive unit. In the case of a pneumatic or hydraulic drive unit, the driving power storage unit is, for example, a storage tank, which is permanently filled with an adequate compressed air tank or hydraulic fluid tank, which is under sufficient pressure.

Said driving power storage unit assures a proper functioning of the device at all times, particularly also, for example, during an accident with failure of a power supply network and/or of pneumatic or hydraulic supply lines and/or of compressors or hydraulic pumps, i.e., particularly a movement of the closing element to the closed position and preferably also again movement of the closing element to the open position. To this end, a check valve is arranged expediently between the driving power storage unit and the compressor or the hydraulic pump in the respective supply line directly to the driving power storage unit to prevent the escape of compressed air or hydraulic fluid from the driving power storage unit in the direction of the compressor or hydraulic pump.

In a pneumatic or hydraulic drive unit, a cylinder of the drive unit is connected preferably via a feed pressure line and a return pressure line to the pneumatic or hydraulic driving power storage unit, whereby a valve for regulating an incoming or outgoing air volume is arranged in each case in both pressure lines, preferably at the cylinder. These valves are designed, for example, as so-called needle valves. In addition, a controllable magnetic valve is arranged in one of the pressure lines, expediently in the feed pressure line.

In the case of the magnetic valve, a closing of the valve occurs by switching of an electromagnet, for example, by control of the closing element. The needle valves, also called throttle valves, can be adjusted and controlled manually. By adjustment of the needle valves, the closed state thereof and thereby flow volume can be controlled, so that a motion speed of the closing element is infinitely variable.

In a detected hazardous situation, the magnetic valve is triggered, as a result of which said valve opens and compressed air or hydraulic fluid can flow into the cylinder through the feed pressure line. Furthermore, the magnetic valve also opens in the case of a breakdown, which results in a lack of power to the magnetic valve, for example, in the case of an accident. Owing to the opened magnetic valve, the closing element moves automatically to the closed position, for example, with a closing speed of up to 0.2 m/s, depending on set closing state of the needle valves.

By a complete closing of both needle valves of the particular cylinder, the closing element further can be held, for example, also in an intermediate position, for example, for maintenance work.

The shape of the closing element is advantageously matched to the specific opening bottom; i.e., particularly a bottom side of the closing element is designed corresponding to the opening bottom. For example, in the case of an opening bottom running obliquely along an opening width, the bottom side of the closing element is designed oblique, corresponding to the opening bottom, to assure a sealing fit of the bottom side of the closing element at the opening bottom over an entire length of the closing element.

In an advantageous embodiment, the counterweight is connected to both side end regions of the closing element. In this way, particularly in closing elements with a long length, uniform movement of the closing element is made possible and jamming of the closing element in the guides is avoided, because there is always a uniformly distributed application of force by the counterweight on the closing element. Further, during failure of one of the connections of the counterweight to the closing element, yet another connection is present to hold the closing element in position, so that a sudden and uncontrolled falling of the closing element is avoided.

Preferably, the drive unit is coupled to the counterweight. In other words, the drive unit is coupled via the counterweight to the connecting element. As a result, additional connections between the drive unit and the connecting element are avoided and the complexity and required installation space are reduced. In the case of a pneumatic or hydraulic drive unit, this unit is arranged, for example, under the counterweight and coupled via a piston rod to the counterweight. The closing element can be moved by raising or lowering the counterweight.

The counterweight and the closing element are expediently connected together by at least one cable, for example, a steel cable or a plastic cable, which is guided over a multiplier pulley block or a power pulley block. The multiplier pulley block in this case advantageously has a factor greater than one; i.e., it has at least one movable cable pulley and one fixed cable pulley. In said multiplier pulley block with a factor greater than one or in said power pulley block, a path traversed by the counterweight is shorter than a path traversed by the closing element; i.e., a relatively large lifting path or lowering path of the closing element can be realized by a relatively small lifting path or lowering path of the counterweight.

In this way, the counterweight, which itself has a relatively large height, can be arranged next to the opening and the drive unit, for example, the pneumatic or hydraulic drive unit, can be arranged below the counterweight. This type of arrangement enables only a relatively small movement path of the counterweight. The multiplier pulley block or the power pulley block nonetheless enables a sufficient lifting height, i.e., a sufficient movement path of the closing element, to lower the closing element completely into the closed position and to raise it completely to the open position. In this case, because of the movement path of different length, a height dimension of the counterweight can also be greater than a height dimension of the closing element. Furthermore, in a pneumatic or hydraulic drive unit a cost-effective relatively smaller cylinder can be used, which enables only a relatively small piston stroke.

For example, in the case of a multiplier pulley block with the factor of four, i.e., with four bearing cable sections and a fourfold deflection of the cable at two fixed and two movable cable pulleys, a movement of the closing element by 12 meters can be realized at the cable pulleys by a movement of the counterweight by 3 meters, so that a device of this type can also be easily installed, for example, in large entrance doors and in the open position, furthermore, makes possible unimpeded access, for example, for large transport vehicles.

However, when using a multiplier pulley block or power pulley block of this type, the counterweight must also be adapted accordingly in each case. Thus, for example, in the case of a multiplier pulley block with the factor of four, a counterweight is needed which is four times heavier than the closing element. Because of the small necessary movement path for the counterweight, however, it can be designed, for example, as a plurality of single weights, which are arranged, for example, below one another and connected to one another.

By adjustment of a cable length, the closing element can be positioned optimally in the device and its height in particular can be controlled. For this purpose, the cable is attached preferably in the area of at least one cable end or both cable ends in such a way that it is simple to loosen, to change the cable length and to reattach the cable. The cable is attached, for example, with a cable end to the closing element and with the other cable end to a frame cross member, which is arranged horizontally above the opening.

Advantageously, at least one cable pulley of the multiplier pulley block or of the power pulley block is assigned a protective cover, which covers the cable pulley over part of its periphery and over its entire width and whose distance to an upper edge of a flank of the cable pulley is smaller than a cable diameter. Popping of the cable out of the cable pulley and thereby disruption of the function of the device are prevented in this way. Preferably, when using a plurality of cable pulleys, all cable pulleys have this type of protective covers. These protective coverings are attached, for example, to so-called fixed caster mountings for the cable pulleys. The employed deflection pulleys also advantageously have such protective coverings, which are designed and arranged in analogy to the protective coverings for the cable pulleys.

Expediently an outer periphery of the counterweight is made out-of-round in at least one place. In other words, the outer periphery of the counterweight, for example, is designed rectangular, polygonal, or oval or is otherwise formed. Twisting of the counterweight and thereby, for example, during use of a pulley block, tangling of the cable sections and a resulting disruption of device function are prevented in this way. Moreover, loosening of the counterweight from the cable and/or the drive unit, to which the counterweight is attached, for example, by threaded rods, is prevented.

In order to prevent such twisting of the counterweight especially effectively, the counterweight is arranged preferably within a weight guide, corresponding to the outer periphery of the counterweight, and guided movably in this weight guide. For example, the counterweight has a rectangular outer periphery and the weight guide has a rectangular interior cross section corresponding thereto. The weight guide is attached, for example, to the outer wall of the room next to the opening. The edges of the counterweight are preferably rounded off to prevent catching of the counterweight.

In an especially preferred embodiment, the device comprises at least two counterweights, which are connected to the closing element independently of one another. The weight force needed for the closing element is distributable in this way between two counterweights. The height of the individual counterweights is much smaller as a result, so that a sufficient movement path of the counterweights next to the opening is assured. These counterweights are arranged, for example, in each case on a side of the opening.

Preferably, each counterweight is connected to both side end regions of the closing element. For example, a counterweight arranged to the left of the opening is connected by a cable to a left side end region and by another cable to a right side end region. A counterweight arranged to the right of the opening is connected by a cable to a left side end region and by another cable to a right side end region, so that the device has at least four separate cables.

Even with a plurality of weights, uniform movement of the closing element is thereby made possible without the danger of jamming in the guides, because there is always a uniformly distributed application of force by the counterweights on the closing element, i.e., in each case on both side end regions thereof. Moreover, in each of the counterweights a connection to the closing element can tear off, without the closing element falling; i.e., in each case one of the two cables of each of the counterweights can tear.

Especially preferably each counterweight is coupled to a drive unit; i.e., the device has two drive units each of which is arranged on a side of the opening and in each case is connected by one of the counterweights to the closing element. In this way, each of the drive units can also be made smaller, lighter, and more cost-effective, because a total driving power of the drive units is sufficient for moving the closing element. Alternatively, the drive units can be designed with some redundancy, i.e., that also with the failure of one of the drive units an unrestricted movement of the closing element continues to be possible.

Preferably, the drive units are pneumatic or hydraulic drive units whose pistons are connected to the respective counterweight and which in each case are connected to the driving power storage unit. Uniform movement of the closing element is made possible by a uniform distribution of pressure on the drive units and jamming of the closing element is prevented. Because the drive units move the counterweights, which are connected in the described manner by cables to the side end regions of the closing element, as already described uniform movement of the closing element is made possible without the risk of jamming in the guides, because there is always a uniformly distributed application of force on the closing element, i.e., in each case on the two side end regions thereof.

The device comprises preferably at least one sensor to detect a hazardous situation, which requires movement of the closing element into the closed position. This enables an automatic actuation of the device, i.e., automatic movement of the closing element to the closed position if a hazardous situation occurs.

The sensor is, for example, a fire alarm, which is coupled, for example, to a sprinkler system, i.e., to an automatic fire extinguishing system of the room. Furthermore, the sensor can also be, for example, a camera, which is coupled to an image evaluation unit to be able to detect hazardous situations automatically.

Especially preferably, the sensor is a moisture sensor, particularly a liquid level sensor. This is designed, for example, as an oscillating probe, which is arranged in the vicinity of the device. This oscillating probe oscillates at a predefined frequency. The oscillation of the oscillating probe changes upon contact with a liquid, for example, with water, a slurry, oil, or substantially liquid extinguishing agent. In order to avoid false activations, for example, by raindrops or during cleaning work, the device is expediently actuated only after a predefined time after a first detection of the liquid, for example, only after 1 to 3 seconds.

Preferably the closing element in the closed position is lockable and fixable, for example, fixable at the opening bottom, in order to avoid a horizontal and/or vertical movement and/or deformation of the closing element, for example, owing to liquid pressure acting on one side, wind pressure in thunderstorms, and/or owing to an effect of washed up or overturned objects. Closing elements with a long length, i.e., very wide closing elements for closing very broad openings, without a deformation of the closing element, are made possible by fixing units, which are distributed over a length of the closing element and by which the closing element is fixable at the opening bottom.

Furthermore, the device preferably has rigid safety catch plates on the top side of the closing element and other fixing units in the form of tensioning hooks in the area of the side guides of the closing element. In the closed state, the tensioning hooks are to be hooked automatically into the safety catch plates, as a result of which a horizontal and/or vertical movement and/or dynamic deformation due to forces, applied on one side, by dammed up liquids, a wind load, or objects and also a static deformation due to the length and weight of the closing element are also prevented. For example, these safety catch plates also take up forces from objects falling on the closing element, for example, falling parts of buildings or trees. Deformation of the closing element and particularly a pulling out of the side guides caused thereby are prevented by the tensioning hooks hooked into the safety catch plates.

The fixing units and/or the additional fixing units designed as tensioning hooks preferably can be operated pneumatically, hydraulically, by a motor, and/or mechanically. They are coupled especially preferably to the at least one driving power storage unit.

In addition, the closing element preferably has rigid vertical profile elements, which are arranged, distributed over the entire length of the closing element, on an outer side and/or an inner side facing the room and attached, for example, in a bonding manner, form fittingly, or force-fittingly, for example, welded, to the closing element. Loads acting on the closing element are distributable in this way over an entire expanse of the closing element. These profile elements are arranged, for example, in the side areas of the closing element and formed wedge-shaped, whereby the wedge shape increases in the upward direction. In this way, in the closed state of the closing element a tight pressing of the closing element against the side seals is made possible, so that a good seal is assured.

The guides for the closing element are preferably U-shaped and have in the lower area rubberized inlet wedges, which enable a precise fit of the closing element in the guides and particularly enable a tension-free temperature-induced expansion of the closing element. This is important particularly in closing elements with a long length, because here very large temperature-induced expansions can occur, for example, in a fire.

The device preferably has at least one switching unit, for example, in the form of a so-called reed contact at the cylinder of the pneumatic or hydraulic drive unit, which, for example, in the closed position of the closing element triggers, to enable other electrical switches, for example, to actuate a fixing device to fix the closing element in the closed position. The switching unit or another switching unit can be triggered further also by the closing element itself during the movement thereof.

The device expediently has at least one optical and/or acoustic warning means, to warn persons before a movement of the closing element and thereby to prevent a hazardous situation, for example, an injury by collision of the closing element with persons or pinching of persons or damage to objects or vehicles.

Exemplary embodiments of the invention will be described in greater detail below with use of drawings.

DETAILED DESCRIPTION

Figure 1:
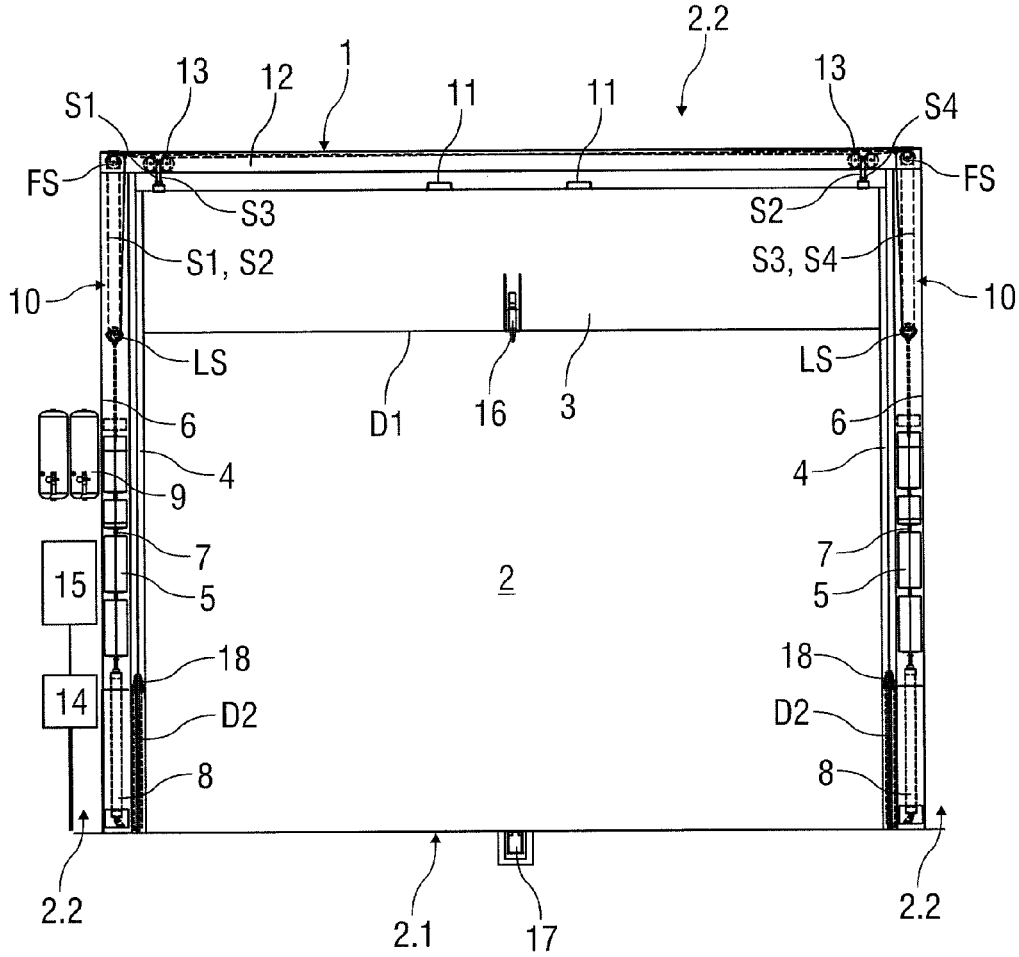
FIG. 1 shows a schematic illustration of a device for the at least partial closing of an opening of a room with a closing element in the open position.

Parts corresponding to one another are provided with the same reference characters in all figures.

Figure 2:
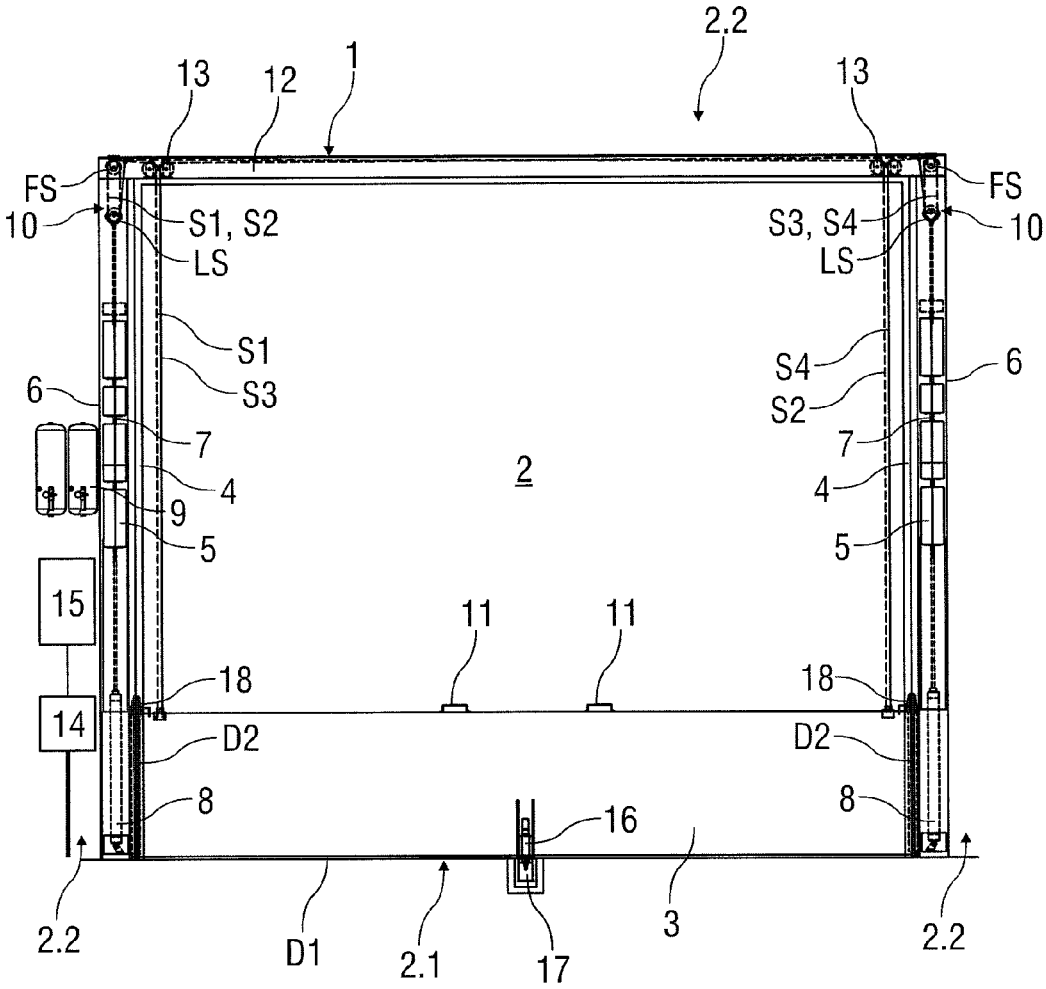
FIG. 2 shows a schematic illustration of a device for the at least partial closing of an opening of a room with a closing element in the closed position.

FIGS. 1 and 2 show schematic illustrations of a device 1 for the at least partial closing of an opening 2 of a room with a closing element 3 in an open and closed position, respectively.

A device 1 of this kind is used, for example, for sealing the room against water entering the room from outside, for example, in a flood event, or against an escape of liquids from the room into the environment, for example, in an accident in which an escape of environmentally harmful substances and/or fire-fighting water from the room is to be prevented. For this reason, device 1 is installed, for example, at openings 2 of rooms which are used as storage rooms for environmentally harmful substances or as a production facility where substances of this kind are stored, processed, and/or produced.

Closing element 3, also called, for example, a safety, retention, or accident barrier or bulkhead, in the closed position is set here sealingly against liquids on an opening bottom 2.1. Closing element 3 for this purpose has on a bottom side a suitable sealing element D1. Further, at least in said closed position seals D2 are also arranged between side guides 4 and closing element 3.

Side guides 4 are attached on the side of opening 2 to an outer wall 2.2 of the room, in the example shown here to an outer side of outer wall 2.2, whereby in the closed position seals are also arranged between guides 4 and outer wall 2.2 at least to the height of a top side of closing element 3. As a result, in the closed position of closing element 3, opening 2 of the room is closed fluid-tight up to the height of the top side of closing element 3. In this way, a liquid to be retained can reach a damming height which corresponds to the height of closing element 3, without entering the room or escaping from the room.

Side guides 4 are arranged vertically on both sides of opening 2. In these guides 4, which are designed, for example, as rails with a U-shaped profile, closing element 3 is guided vertically movable between the open position in an upper area of opening 2 and the closed position on opening bottom 2.1.

Closing element 3 is connected by cables S1, S2, S3, S4, for example, by metal cables, such as steel cables, or by plastic cables to counterweights 5. Counterweights 5 are arranged on both sides of opening 2 and dimensioned such that closing element 3 is held in its particular position without an additional force acting on closing element 3.

An outer periphery of counterweights 5 is designed rectangular over their vertical dimension and arranged within a weight guide 6 corresponding to the outer periphery of counterweights 5 and guided movable in it; i.e., weight guide 6 has a rectangular internal cross section, which corresponds to the rectangular outer periphery of counterweights 5. Weight guides 6 are attached on both sides of opening 2 to outer wall 2.2. By this design of counterweights 5 and weight guides 6, twisting of counterweights 5 and thereby tangling of the cables S1, S2, S3, S4 and particularly loosening of counterweights 5 are prevented.

Counterweights 5 are connected to one another and to cables S1, S2, S3, S4, for example, by means of threaded rods 7. Therefore, an uncontrolled turning of weights 5 would perhaps lead to a loosening of threaded rods 7. Advantageously, the edges of counterweights 5 are rounded off, to prevent a catching of counterweights 5 and thereby to assure at all times a continuous smooth movement of counterweights 5 and of closing element 3.

Because closing element 3 is in equilibrium with counterweights 5 and therefore can be held by these in its particular position, only the action of a very small additional force on closing element 3 is necessary to move closing element 3, i.e., to move it from the open position to the closed position, for example, in a hazardous situation and likewise to move closing element 3 from the closed position to the open position.

This small additional force can be realized by drive units 8, which are coupled to closing element 3. Said drive units 8 in the example shown here are designed as pneumatic drive units 8. In other embodiments, which are not shown here, for example, hydraulic or motor, particularly electric motor drive units 8 can also be used. Because of the equilibrium between counterweights 5 and closing element 3, even relatively low-power drive units 8 are sufficient for moving closing element 3; therefore, the drive units can be made very small and light and are very cost-effective.

Drive units 8, which in analogy to counterweights 5 are arranged on both sides of opening 2 and in each case below counterweights 5, each comprise a vertically arranged pneumatic cylinder, in which a piston is arranged movable by gas pressure, advantageously by air pressure. The pistons are each coupled via a piston rod to counterweights 5 arranged above the respective drive unit 8 and in this way are coupled via counterweights 5 and cables S1, S2, S3, S4 to closing element 3. In this regard, threaded rod 7 of the respective side can be formed, for example, as a piston rod of the respective drive unit 8 and in this way be coupled to the piston in the pneumatic cylinder, or the particular piston rod is connected to, for example, screwed into, the respective threaded rod 7. Closing element 3 can be raised or lowered by a pneumatic movement of the piston and a resulting movement of counterweights 5.

Owing to the coupling of drive units 8 to counterweights 5, no additional connections between drive units 8 and closing element 3 are necessary, as a result of which the complexity of device 1 and the installation space needed for device 1 are reduced and drive units 8 can be installed directly next to opening 2 at outer wall 2.2 of the room; for example, these can be arranged in weight guides 6 and thereby protected from environmental effects, for example, soiling or from damage due to collision of objects or vehicles with drive units 8. A movement mechanism of drive units 8 and counterweights 5, i.e., the retracting and extending piston rod, and the moving counterweights 5 are also protected in this way, for example, from contact, as a result of which danger to persons is avoided.

Because of the two drive units 8, each drive unit 8 can be made smaller, lighter, and more cost-effective, because the total driving power of both drive units 8 together are sufficient for moving closing element 3. In addition, uniform movement of closing element 3 is made possible by the uniform pressure distribution on drive units 8 with compressed air and jamming of closing element 3 owing to an irregular movement of the pistons of drive units 8 is prevented.

Alternatively to small drive units 8, whose combined driving power is sufficient only for moving closing element 3, drive units 8 can also be made such as to have some redundancy, i.e., that an unrestricted movement of closing element 3 continues to be possible also in the case of failure of one of drive units 8. To this end, each drive unit 8 is dimensioned in such a way that even the driving power of only one of drive units 8 would be sufficient for moving closing element 3. This type of redundancy, i.e., the functioning of device 1 also in the event of a failure of one of drive units 8, for example, is important and possibly required by legal regulations, when environmentally hazardous substances and/or substances harmful to health or other hazardous materials are stored and/or processed in the room which is to be closed by closing element 3.

Drive units 8 are coupled to a driving power storage unit 9 via compressed air lines, which are not shown in greater detail here. This driving power storage unit 9 is designed as a storage tank for the pneumatic drive units 8 employed here and is permanently filled with an adequate supply of compressed air under sufficient pressure.

Driving power storage unit 9 is connected, for example, to a compressor or to a compressed air supply system via a supply line in order to fill driving power storage unit 9. Such compressed air supply systems are often already present as a standard feature at industrial plants to be able to operate, for example, pneumatic tools, so that only the supply line needs to be connected to a compressed air supply system of this type.

In order to prevent escape of the compressed air from driving power storage unit 9 in the event of a failure of the compressor or the compressed air supply system, for example, in an accident, a connection for the supply line at the driving power storage unit 9 has a check valve, not described in greater detail here, which enables the flow of compressed air into the driving power storage unit 9, but prevents outflow from the driving power storage unit 9 through the check valve.

In this way, driving power storage unit 9 assures proper functioning of device 1 at all times, especially also, for example, in an accident with failure of the compressor or the compressed air system, i.e., especially the movement of closing element 3 into the closed position and preferably also a movement of closing element 3 into the open position, because sufficient driving power in the form of stored compressed air in the driving power storage unit 9 to drive units 8 is available at all times.

The cylinders of drive units 8 are each connected via a feed pressure line, not shown in greater detail here, and a return pressure line, also not shown in greater detail here, to the pneumatic driving power storage unit 9, whereby in each case a valve for regulating an incoming or outgoing air volume is arranged in both pressure lines of the particular cylinder, preferably at the cylinder. These valves, not shown in greater detail here, are designed, for example, as so-called needle valves. In addition, a controllable magnetic valve, not shown in greater detail, is arranged in one of the pressure lines, expediently in the feed pressure line.

In the case of the magnetic valve, closing of the valve occurs by switching of an electromagnet, for example, by a control of closing element 3. The needle valves, also called throttle valves, can be adjusted and controlled manually. By adjustment of the needle valves, the closed state thereof and thereby flow volume can be controlled, so that a motion speed of closing element 3 is infinitely variable.

In a detected hazardous situation, the magnetic valve is actuated, as a result of which it opens and compressed air can flow through the feed pressure line into the cylinder. Furthermore, the magnetic valve also opens in the case of a breakdown, which results in a lack of power to the magnetic valve, for example, in the case of an accident. Owing to the opened magnetic valve, closing element 3 moves automatically to the closed position, for example, with a closing speed of up to 0.2 m/s, depending on the set closing state of the needle valves. A complete closing of both needle valves of the particular cylinder also allows for the closing element to be held, for example, in an intermediate position, for example, for maintenance work.

In the advantageous embodiments shown here, counterweights 5 arranged on both sides of opening 2 are each connected to both side end regions of closing element 3 by two cables S1, S2, S3, S4; i.e., the two cables S1, S2 of the left counterweight 5 are connected to the left or right side end region of closing element 3 and the two cables S3, S4 of the right counterweight 5 are also connected to the left or right side end region of closing element 3.

Particularly in the case of very long closing elements 3, uniform movement of closing element 3 is thereby made possible and jamming of closing element 3 in guides 4 is avoided, because of an always uniformly distributed application of force from the particular counterweights 5 and via these also from the respective drive units 8 over both side end regions on closing element 3.

Further, in the event of a failure of one of the connections of the respective counterweights 5 on one side to closing element 3, the other connection of the respective counterweights 5 to closing element 3 is still present to hold closing element 3 in position, so that a sudden and uncontrolled falling of closing element 3 is avoided. In other words, in this embodiment with counterweights 5 on both sides of opening 2, each of which is connected to closing element 3 by two cables S1, S2, S3, S4, one each of the two cables S1, S2, S3, S4 can tear and closing element 3 nevertheless remains stable in its particular position and continues to be movable by drive units 8.

In the advantageous embodiment shown here, cables S1, S2, S3, S4 connecting counterweights 5 on each side to closing element 3, are guided over multiplier pulley blocks 10. In this case, counterweights 5 on each side are each assigned a multiplier pulley block 10; i.e., cables S1, S2 of counterweights 5 of one side are guided over a multiplier pulley block 10 and cables S3, S4 of counterweights 5 of the other side are guided over the other multiplier pulley block 10. As an alternative to multiplier pulley blocks 10, power pulley blocks can also be used in other embodiments, not shown here. The multiplier pulley blocks 10, shown in the exemplary embodiment, have the factor of four; i.e., each of them have four bearing cable sections between the upper fixed cable pulley FS and the lower movable cable pulley LS. The respective cable S1, S2, S3, S4 is deflected four times in this way at the cable pulleys FS, LS of the particular multiplier pulley block 10.

By these multiplier pulley blocks 10 with the factor of four and the fourfold cable deflection at the cable pulleys FS, LS, realized thereby, a path that is to be traversed by the particular counterweights 5 is shorter than a path that is to be traversed by closing element 3; i.e., a relatively large lifting path or lowering path of closing element 3 can be realized by a relatively small lifting path or lowering path of counterweights 5. This allows for the counterweights 5, which have a certain height owing to the relatively high required weight itself, to be arranged next to opening 2 and drive units 8, furthermore, also to be positioned under counterweights 5 and a then still available vertical installation space is still sufficient to bring about a sufficient lowering or raising of closing element 3 by the raising or lowering of counterweights 5, in order to move it both into the lower closed position and into the upper open position.

This arrangement of counterweights 5 and drive units 8 provides only a relatively short movement path of counterweight 5, which with the multiplier pulley blocks 10 with the factor 4, i.e., by the fourfold cable deflection, is completely sufficient. Furthermore, due to the use of multiplier pulley blocks 10 for the pneumatic drive units 8 a cost-effective relatively small cylinder can be used, which enables only a relatively small piston stroke.

For example, in the case of multiplier pulley block 10 with the factor of four, i.e., with four bearing cable sections of cables S1, S2, S3, S4 and a fourfold deflection of cables S1, S2, S3, S4 at the particular cable pulleys FS, LS by a movement of counterweight 5 by 3 meters, a movement of closing element 3 by 12 meters can be realized, so that a device 1 of this type can also be easily installed, for example, at large entrance doors, and in the open position allows unimpeded access, for example, also for large transport vehicles.

Nevertheless, when using multiplier pulley blocks 10 of this type, counterweights 5 must also be adapted accordingly. Thus, for example, in the case of multiplier pulley block 10 with a factor of four, a counterweight four times heavier than closing element 3 is needed. Therefore, for a weight of closing element 3 of, for example, 100 kg, a total counterweight of 400 kg is needed to establish an equilibrium by means of multiplier pulley blocks 10 between closing element 3 and counterweights 5. Because the necessary total counterweight is to be divided between the two sides, counterweights 5 of 200 kg each must be arranged on each side.

In order to realize a safety difference to the weight of closing element 3, for example, counterweights 5 may also weigh slightly less, for example, only 192 kg each. As a result, lowering of closing element 3 is made easier, since it weighs slightly more than counterweights 5. This assures a lowering of closing element 3 and thereby closing of opening 2 under all circumstances.

In the case of complete loss of power, for example, in which all valves of the cylinder of drive units 8 open and drive units 8 substantially exert no force on closing element 3, this element alone through its own weight, which is slightly higher than the total counterweight, can be lowered into the closed position completely without external power. Even in the case of a serious accident with complete loss of control of device 1 and the electrical system of device 1 the closing of opening 2 of the room is assured. In this type of emergency situation with complete failure of the electrical system of device 1, closing element 3 can be moved, furthermore, for example, also manually by means of suitable handles 11 and thus, for example, raised again from the closed position.

Because of the small required movement path for counterweights 5, these can be designed, for example, as shown here, as a plurality of single weights, which are arranged below one another on both sides of opening 2 and connected to one another. In addition, by dividing the total counterweight between counterweights 5 of both sides, a height dimension of counterweights 5 is much smaller than would be the case with a single counterweight, so that a sufficient movement path of counterweights 5 next to opening 2 is assured. Especially with the use of multiplier pulley blocks 10, a cost-intensive use of materials with especially high density is not necessary to achieve the smallest volume possible for counterweights 5.

Particularly in the case of very long closing elements 3, which are very heavy, relatively many and/or large individual weights are needed as counterweights 5 to achieve a weight compensation. With use of multiplier pulley blocks 10 and the cable deflection, it is possible nonetheless to completely lower such closing elements 3 to the closed position and to raise them again completely to the upper open position, to free opening 2 as completely as possible in the open state, because in relation to the lifting path or lowering path of closing element 3 only a substantially smaller lowering path or lifting path of counterweights 5 and the piston rods and the pistons in the cylinders of drive units 8 is necessary.

In this way, for example, also relatively heavy closing elements 3 can be used, which have, for example, a length of 20 m and a height of 2 m, because sufficient counterweights 5 can be used; i.e., for example, a sufficient number of individual weights can be arranged to the side of opening 2 and moved. The height of closing element 3 is the maximum damming height to which the liquids can be held back by closing element 3.

To realize multiplier pulley blocks 10, fixed caster mountings are arranged on both sides of opening 2 above drive units 8 and counterweights 5. These fixed caster mountings are attached, for example, to a frame cross member 12, which is attached horizontally to an outer wall 2.2 above opening 2 and also to the side guides 4, as a result of which a device frame is formed. These fixed caster mountings each have four fixed cable pulleys FS, which are arranged next to one another in the fixed caster mountings on a mutual axis of rotation and are pivotable.

The term fixed caster mountings or fixed cable pulleys FS means that the fixed caster mountings are attached fixedly, i.e., that they are not movable and thereby form a fixed deflection bearing for the cables S1, S2, S3, S4. The fixed cable pulleys FS are in fact movable rotatably, but, because they are arranged on the axis of rotation in the respective fixed caster mounting, they are not movable linearly, i.e., not slidable.

A movable caster mounting is connected to an upper end of counterweights 5 on each side; i.e., this movable caster mounting is movable together with counterweights 5 and moves during lowering of closing element 3 toward the respective fixed caster mounting and during a lifting of closing element 3 away from it and thereby forms a movable bearing for the cables S1, S2, S3, S4. These movable caster mountings each have four movable cable pulleys LS, which are arranged next to one another in the movable caster mountings on a mutual axis of rotation and are pivotable. In other words, the term movable caster mountings or movable cable pulleys LS means that the caster mountings or the movable cable pulleys LS are linearly movable, in the direction of the fixed caster mountings and fixed cable pulleys FS or away from these.

In addition, deflection pulleys 13 are arranged on the frame cross member 12; these are arranged above opening 2, i.e., closer to a middle area of the opening 2 than the upper fixed casters. The cables S1, S2, S3, S4 can be guided over these deflection pulleys 13 from the fixed cable pulleys FS to the side end regions of closing element 3, whereby the cables S1, S2, S3, S4 from deflection pulleys 13 run vertically in the direction of closing element 3.

To realize the multiplier pulley block 10 with the factor of four, each of the cables S1, S2, S3, S4 is attached with the cable end to the frame cross member 12 and guided over a movable cable pulley LS of the movable caster mounting, then over a fixed cable pulley FS of the fixed caster mounting, then again over a movable cable pulley LS of the movable caster mounting, again over a fixed cable pulley FS of the fixed caster mounting, and then over one of the deflection pulleys 13 to closing element 3, to which the other cable end is attached. This occurs analogously for four cables S1, S2, S3, S4, i.e., for two cables each S1, S2, S3, S4 on each of the side counterweights 5, whereby in each case a cable S1, S2, S3, S4 of each counterweight 5 is guided over one of the left deflection pulleys 13 to the left side end region of closing element 3, and the other cable S1, S2, S3, S4 of the respective counterweight 5 over one of the right deflection pulleys 13 to the right side end region of closing element 3.

By setting the cable lengths of the cables S1, S2, S3, S4, closing element 3 can be positioned optimally in device 1 and its height arrangement in particular can be controlled. To this end, the particular cable ends or more precisely stated end regions of the cables S1, S2, S3, S4 can be attached, for example, in cable clamps to closing element 3 and/or to the frame cross member 12, so that the cable lengths can be infinitely variable by opening of the cable clamps, pulling through of the specific cable S1, S2, S3, S4, and again closing of the cable clamps and thereby adjustable to the particular conditions.

Deflection pulleys 13 in particular, but also, for example, the cable pulleys FS, LS in the caster mountings are advantageously each assigned a protective cover or for the particular caster mounting a common protective cover for all of its cable pulleys FS, LS; this covers deflection pulleys 13 or cable pulleys FS, LS over a partial region of its periphery or over its entire width and its distance to an upper edge of a flank of deflection pulleys 13 or cable pulleys FS, LS is smaller than a cable diameter. In this way, a popping of the cable S1, S2, S3, S4 out of the respective deflection pulley 13 or cable pulley FS, LS and thereby a disruption of the functioning of device 1 are avoided, for example, during a slight hesitation in the movement of closing element 3 and a resulting decreasing cable tension. This is particularly important in the case of deflection pulleys 13, because the particular cable S1, S2, S3, S4 in the particular deflection pulley 13 lies against deflection pulley 13 only over about a fourth of the periphery.

Device 1 comprises a sensor 14 for detecting a hazardous situation, which requires movement of closing element 3 into the closed position. This enables an automatic actuation of device 1, i.e., automatic movement of closing element 3 into the closed position if a hazardous situation occurs.

Sensor 14, which is arranged here to the side of opening 2 outside the room, is a liquid level sensor. It is formed as an oscillating probe. The oscillating probe oscillates at a predefined frequency. The oscillation of the oscillating probe changes upon contact with a liquid, for example, with water, a slurry, oil, or substantially liquid extinguishing agent. Oscillating probes of this kind are known, for example, for measuring tank contents, whereby the oscillating probe is installed in a tank or can be arranged in it to determine the liquid level in the tank. In order to avoid false activations, for example, by raindrops or during cleaning work, device 1 is expediently actuated only after a predefined time after a first detection of the liquid, for example, only after 1 to 3 seconds.

Because sensor 14 is arranged here outside the room, device 1 shown here is provided, for example, predominantly for protecting the room from entering flood water. If device 1 is provided predominantly for preventing the escape of a liquid from the room, then sensor 14 is expediently arranged within, the room. Furthermore, naturally also a plurality of sensors 14, for example, can be arranged and used both within and outside the room.

Apart from the described sensor 14, naturally also many other sensors 14 can be used, as well as combinations of said sensors 14, for example, in each case matched to an intended use and site of use of device 1. Another sensor 14 of this type is, for example, a fire alarm, which is coupled, for example, to a sprinkler system, i.e., to an automatic fire extinguishing system of the room. Furthermore, sensor 14 can also be, for example, a camera, which is coupled to an image evaluation unit to be able to detect hazardous situations automatically, or a moisture sensor.

Sensor 14 is coupled to a control unit 15 of device 1, which evaluates detected data from sensor 14 and thereupon if a hazardous situation is detected automatically lowers closing element 3; i.e., it triggers the magnetic valve to move by compressed air from the driving power storage unit 9 the pistons in the cylinders of drive units 8 and thereby counterweights 5 upward, as a result of which closing element 3 is lowered. Further, for example, also a manual control of device 1 is possible with said control unit 15, for example, to again raise closing element 3, after the hazardous situation has passed or to operate closing element 3 manually, for example, to move it to a central position and to stop it there for maintenance purposes.

To enable a secure sealing of the room, closing element 3 in the closed position preferably is lockable and fixable, for example, fixable at opening bottom 2.1, as shown here, in order to avoid a horizontal and/or vertical movement and/or deformation of closing element 3, for example, due to liquid pressure acting on one side, wind pressure in thunderstorms, and/or due to an effect of washed up or overturned objects.

Use of closing elements 3 with a long length, i.e., of very broad closing elements 3 for closing very wide openings 2 without a deformation of closing element 3 is made possible by fixing units 16, which are distributed over an entire length of closing element 3 and by which closing element 3 is fixable at opening bottom 2.1. In the shown exemplary embodiment, only one such fixing unit 16 is arranged on closing element 3. The longer the length of closing element 3 relative to its height, the more susceptible closing element 3 is to static deformations, i.e., for example, bending due to its own weight, and dynamic deformations due to applied forces such as wind loads, water pressure, or colliding objects. For example, closing elements 3 that have a length of 20 m and a height of 20 cm can also be realized with fixing units 16.

Fixing units 16 are designed, for example, as centering pins and hooks, which can be lowered into hollow spaces 17 in opening bottom 2.1 and are hookable therein. In this regard, insertion into the particular hollow space 17 and hooking by means of the hook in hollow space 17 and thereby a secure fixing of closing element 3 at opening bottom 2.1 are made possible, particularly by the centering pin, which is made hollow and in which a hook is arranged and is pivotable out of it, also with an even slight deformation during the lowering of closing element 3 by a wind load, water pressure, or collision with objects.

The pivoting of the hooks for fixing closing element 3 at opening bottom 2.1 also occurs advantageously pneumatically. Therefore, fixing units 16 are also preferably coupled to driving power storage unit 9. An adequate compressed air tank with a sufficient pressure is then to be stored in the storage unit to assure both the movement and the fixing of closing element 3.

In addition, device 1 has, for example, additional fixing units 18 arranged at guides 4, also called tensioning hooks, over-dead-center tensioners, or quick releases. These additional fixing units 18 in the form of tensioning hooks are pivotable in the closed state of closing element 3 to its upper side, preferably also pneumatically, so that closing element 3 is held securely in this closed position also by these additional fixing units 18. Further, a safety catch to prevent closing element 3 from being pulled out of guides 4, which are designed, for example, as U-shaped rails, is realized thereby. Advantageously, these additional fixing units 18 are coupled to driving power storage unit 9. As already noted, an adequate compressed air tank with sufficient pressure is to be stored in the storage unit to assure both the movement and the fixing of closing element 3.

Further, device 1 preferably has rigid safety catch plates on the top side of closing element 3 in the area of the additional fixing units 18, i.e., a reinforcement of closing element 3 in this area. In the closed state, fixing units 18, made as tensioning hooks, are to be hooked automatically securely and fixedly into the hook-in openings provided in the safety catch plates, as a result of which a horizontal and/or vertical movement and/or dynamic deformation due to forces, applied on one side, by dammed up liquids, wind loads, or objects and, furthermore, static deformation due to the length and weight of closing element 3 are reliably prevented. These safety catch plates also take up, for example, forces from objects falling on closing element 3, for example, falling parts of buildings or trees. Deformation of closing element 3 and particularly a pulling out of the side guides 4 caused thereby are prevented by the tensioning hooks hooked into the safety catch plates.

In addition, closing element 3 preferably has rigid perpendicular profile elements, not shown in greater detail here, which are arranged, distributed over the entire length of closing element 3, on an outer side and/or an inner side facing the room and attached, for example, in a bonding manner, form fittingly, or force-fittingly, for example, welded, to closing element 3. Loads acting on closing element 3 are distributable in this way over an entire length and height of closing element 3. These profile elements are arranged, for example, in the side areas of closing element 3 and designed wedge-shaped, whereby the wedge shape increases in the upward direction.

In this way, in the closed state of closing element 3 a tight pressing of closing element 3 against the side seals D2 is made possible, so that a good seal is assured.

Guides 4 for closing element 3 are preferably U-shaped and have in the lower area the side seals D2 in the form of rubberized inlet wedges, which enable a precise fit of closing element 3 in guides 4 and particularly enable a tension-free temperature-induced expansion of closing element 3. This is important particularly in closing elements 3 that are very long, because here very large temperature-induced expansions can occur, for example, in a fire. These expansions can amount up to 40 mm in the case of a closing element 3 that is 2 meters long at temperatures of 200° C. in the case of fire.

Device 1 preferably has at least one switching unit, not shown in greater detail, for example, in the form of a so-called reed contact at the cylinders of the pneumatic or hydraulic drive units 8, which trigger, for example, in the closed position of closing element 3, to enable other electrical switches, for example, to actuate a fixing device to fix closing element 3 in the closed position. The switching unit or an additional switching unit, furthermore, can also be triggered by closing element 3 itself during its movement and, for example, be designed as a trigger plate, which can be activated by lowering closing element 3 and thereby activates, for example, a valve, to activate fixing units 16 and additional fixing units 18. The switching units are also coupled, for example, to control unit 15, so that a coordinated control of the movement of closing element 3 and other functions, for example, the fixing of closing element 3 in the closed position is possible.

Device 1 expediently has at least one optical and/or acoustic warning means, not shown in greater detail, for example, in the form of a flashing light and/or a siren, to warn persons before a movement of closing element 3 and thereby to prevent a danger, for example, injury by collision of closing element 3 with persons or pinching of persons or damage to objects or vehicles. This warning means is expediently coupled to control unit 15, to activate it during a lowering of closing element 3 and advantageously also during raising of closing element 3.

LIST OF REFERENCE CHARACTERS

1 device
2 opening
2.1 opening bottom
2.2 outside wall
3 closing element
4 guide
5 counterweight
6 weight guide
7 threaded rod
8 drive unit
9 driving power storage unit
10 multiplier pulley block
11 handle
12 frame cross member
13 deflection pulley
14 sensor
15 control unit
16 fixing unit
17 hollow space
18 additional fixing unit
D1 sealing element
D2 seal
FS fixed cable pulley
LS movable cable pulley
S1, S2, S3, S4 cable

The invention claimed is:

1. A device for the at least partial closing of an opening of a room comprising a closing element which is placeable sealingly on an opening bottom and is guided vertically movable in guides, which are arranged vertically on both sides of the opening, between an open position in an upper area of the opening and a closed position on the opening bottom and which is connected to at least one counterweight, by means of which the closing element is held motionless in its particular position without an additional force acting on the closing element, wherein the closing element is coupled to at least one pneumatic drive unit or hydraulic drive unit for moving the closing element, whereby the drive unit is coupled to at least one driving power storage unit, wherein the at least one counterweight and the closing element are connected together by at least one cable, which is guided over a multiplier pulley block or over a power pulley block, wherein the at least one counterweight comprises first and second counterweights, the first counterweight being connected to the closing element independently of the second counterweight, the first counterweight being located on a first lateral side of the closing element and the second counterweight being located on a second lateral side of the closing element, wherein the first counterweight is connected to a first lateral side portion of the closing element and to a second lateral side portion of the closing element and wherein the second counterweight is connected to the first lateral side portion of the closing element and to the second lateral side portion of the closing element, wherein the at least one pneumatic drive unit or hydraulic drive unit comprises a first pneumatic drive unit or hydraulic drive unit connected to the first counterweight for driving the first counterweight independently of the second counterweight and a second pneumatic drive unit or hydraulic drive unit connected to the second counterweight for driving the second counterweight independently of the first counterweight, wherein the at least one driving power storage unit comprises at least one needle valve and a magnetic valve, wherein the first pneumatic drive unit or hydraulic drive unit comprises a first piston rod and the first pneumatic drive unit or hydraulic drive unit is connected to the first counter weight via the first piston rod, and wherein the second pneumatic drive unit or hydraulic drive unit comprises a second piston rod and the second pneumatic drive unit or hydraulic drive unit is connected to the second counter weight via the second piston rod, wherein the magnetic valve is configured to switch from a closed state, in which the closing element is held in an open position, to an open state, in which the closing element moves to a closed state, wherein the magnetic valve automatically switches to the open state in a case of a detected hazardous situation or in a case of a breakdown.

2. The device according to claim 1, wherein the first and second counterweights are connected to both side end regions of the closing element.

3. The device according to claim 1, wherein one of the first drive unit and second drive unit is coupled to the first counterweight or the second counterweight.

4. The device according to claim 1, wherein an outer periphery of the first counterweight or the second counterweight is made out-of-round at least one place.

5. The device according to claim 4, wherein the first and second counterweights are arranged within a weight guide, corresponding to the outer periphery of the first and second counterweights.

6. The device according to claim 1, wherein the first counterweight and the second counterweight are connected to the closing element independently of one another.

7. The device according to claim 1, further comprising at least one sensor to detect a hazardous situation, which requires the movement of the closing element into the closed position.

8. The device according to claim 1, wherein the closing element is formed as a hollow chamber profile.

9. The device according to claim 1, comprising at least one optical or acoustic warning means.

10. The device according to claim 1, comprising at least one fixing unit, which is arranged on closing element and by which the closing element is fixable at the opening bottom.

11. The device according to claim 10, wherein the at least one fixing unit is formed as a hollow centering pin lowerable into a hollow space in the opening bottom.

12. The device according to claim 10, wherein additional fixing units, which in a closed state of the closing element are pivotable toward an upper side of the closing element, are arranged at the guides.

13. The device according to claim 10, wherein the at least one fixing unit is coupled to the at least one driving power storage unit.

14. The device according to claim 1, wherein the closing element is coupled to the first pneumatic drive unit or hydraulic drive unit by the first piston rod and the closing element is coupled to the second pneumatic drive unit or hydraulic drive unit by the second piston rod.

15. The device according to claim 1, wherein the guides are arranged in a U-shape.

16. The device according to claim 1, wherein the at least one needle valve and the magnetic valve are separate units.

17. The device according to claim 1, wherein the at least one needle valve and the magnetic valve have different functions.

18. The device according to claim 1, where wherein the at least one needle valve and the magnetic valve are separate units having different functions.

19. The device according to claim 1, wherein the at least one needle valve is configured to be controlled manually prior to detection of a hazardous situation.

20. The device according to claim 1, wherein the at least one needle valve is configured to adjust a motion speed of the closing element.

21. The device according to claim 20, wherein the at least one needle valve is configured to adjust the motion speed by adjusting a flow volume of compressed air or hydraulic fluid.

22. The device according to claim 1, wherein the closing element has a hollow chamber profile.

23. The device according to claim 22, wherein the hollow chamber profile comprises a plurality of individual hollow chamber profiles stacked on one another and connected to one another.

24. The device according to claim 23, wherein the plurality of individual hollow chamber profiles have different heights.

* * * * *